US006056624A

United States Patent [19]

Fildan

[11] Patent Number: 6,056,624

[45] Date of Patent: May 2, 2000

[54] PIN AND EYE ASSEMBLY FOR BRASSIERES

[76] Inventor: Gerhard Fildan, Wohnpark Alte Eriaa, Anton Baumgartner Str. 44, C 4 17 01, A 1232 Vienna, Austria

[21] Appl. No.: 09/063,134

[22] Filed: Apr. 20, 1998

[51] Int. Cl.[7] ..... A41C 3/00

[52] U.S. Cl. ..... 450/1; 450/47; 24/114.9

[58] Field of Search ..... 24/694, 114.7, 24/108, 90.1, 106, 107, 114.9; 2/244, 246; 450/41, 45, 46, 47, 48, 51, 52, 1

[56] References Cited

U.S. PATENT DOCUMENTS 44,064 3/1913 Keller ..... 24/694

3,747,606 7/1973 Tareau ..... 450/45

5,816,889 10/1998 Fildan ..... 450/45

*Primary Examiner*—Gloria M. Hale

*Attorney, Agent, or Firm*—Herbert Dubno

[57] ABSTRACT

A pin-and-eye connection is used to apply decorative members or stays or underwires, especially the foundation garments, utilizing a member which is stitched to the garment and preferably a cover member which conceals that stitching. Where the base is used as a decorative member, it can be provided with a circumference of pearl like formations.

33 Claims, 12 Drawing Sheets

19
14
12
17
15
101
100
18
13
16
11
10
18

FIG. 2
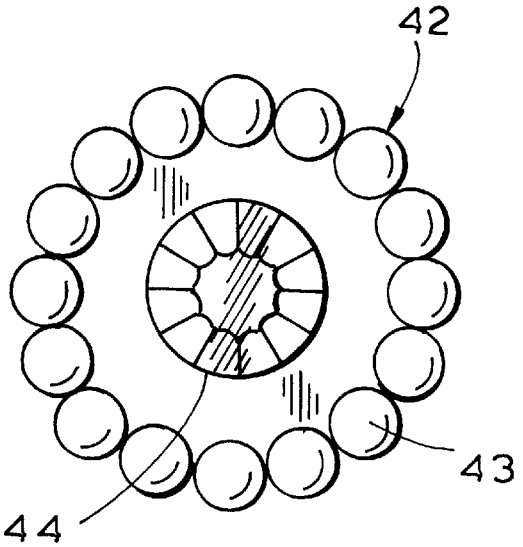
FIG. 3
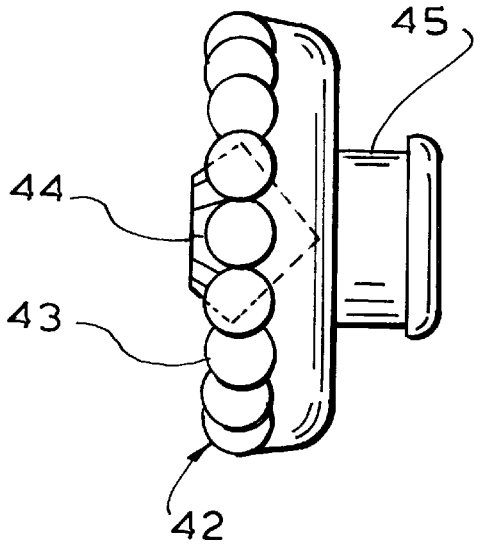
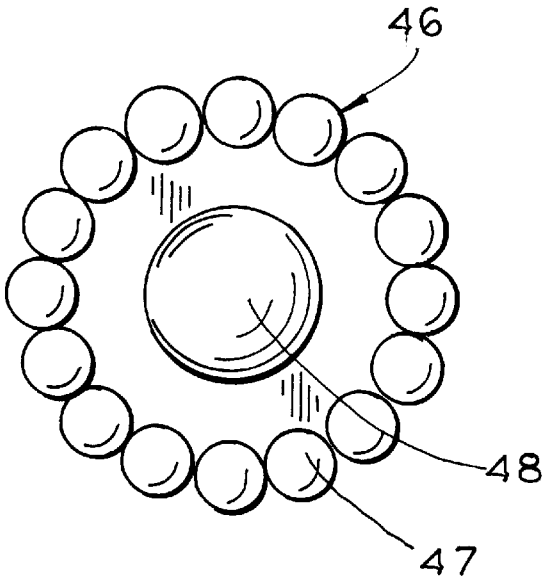
FIG. 4
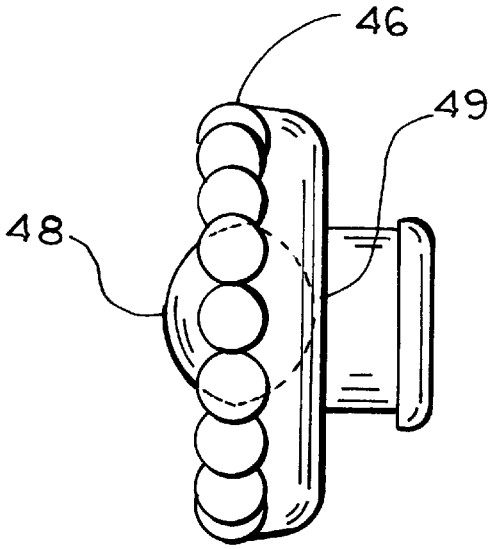
FIG. 5

FIG. 6
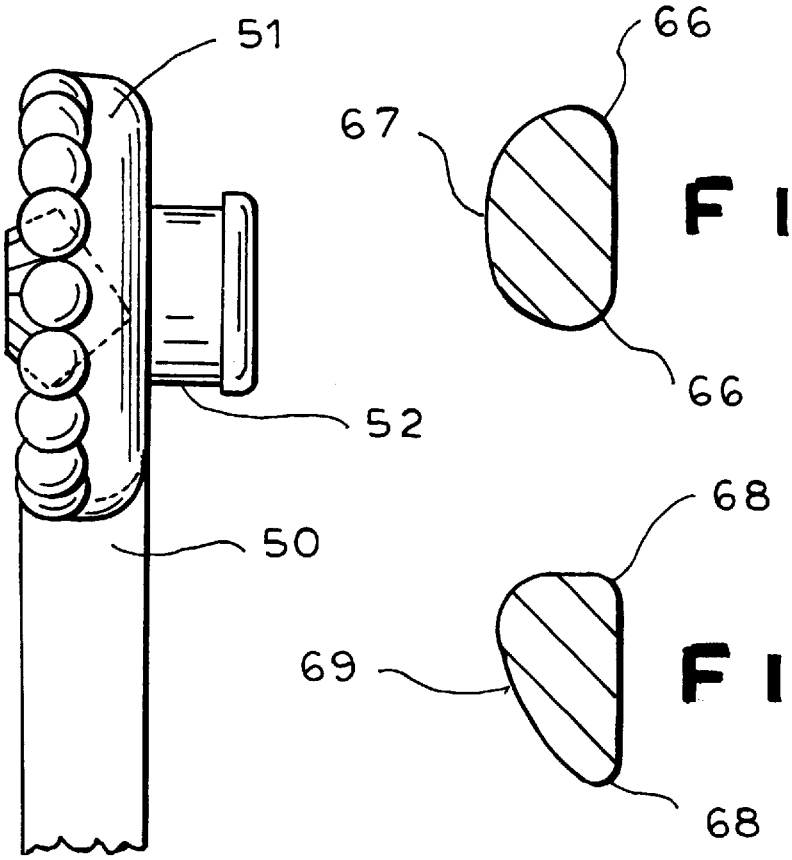
FIG. 16
FIG. 15
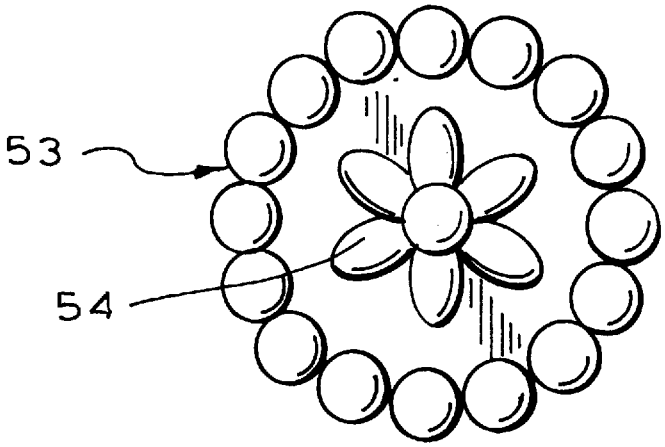
FIG. 7

FIG. 9
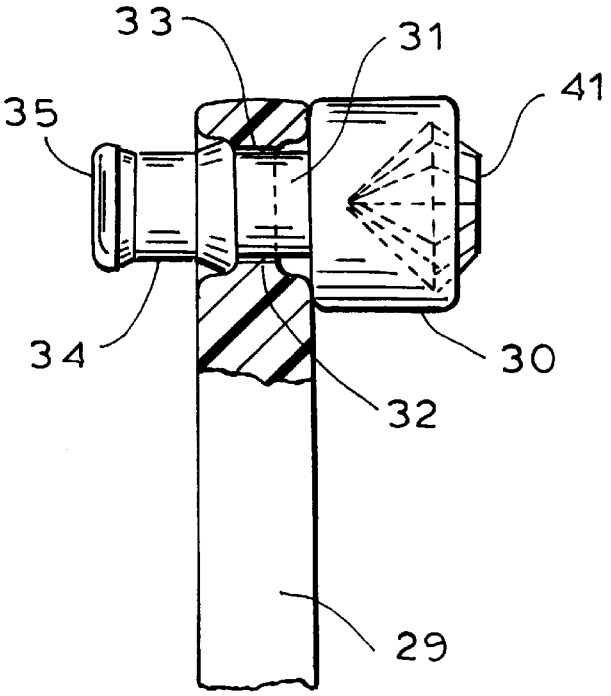
FIG. 10
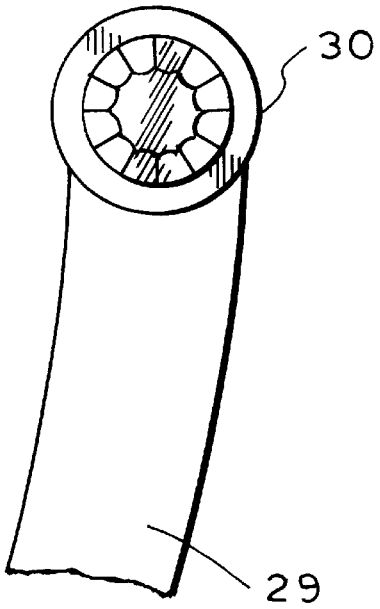
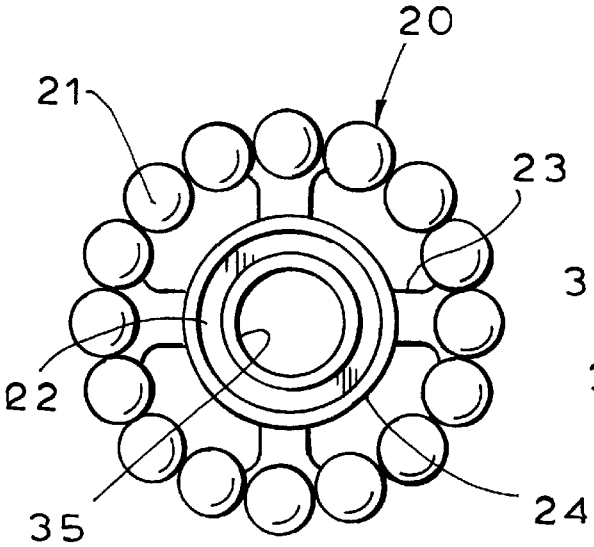
FIG. 11
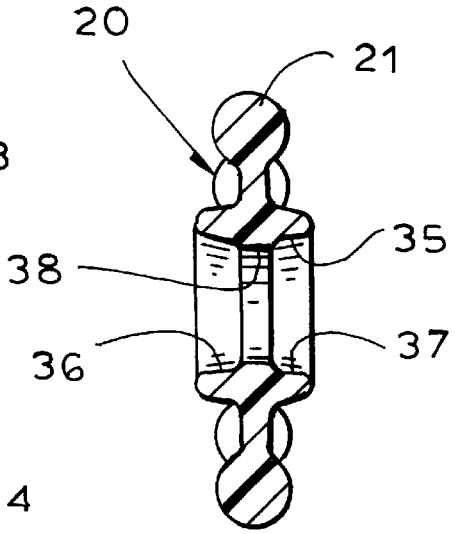
FIG. 12

FIG. 13
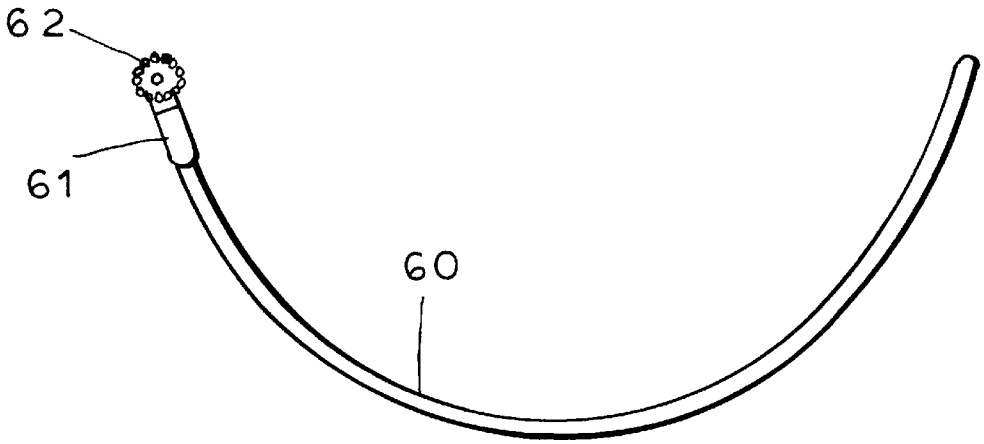
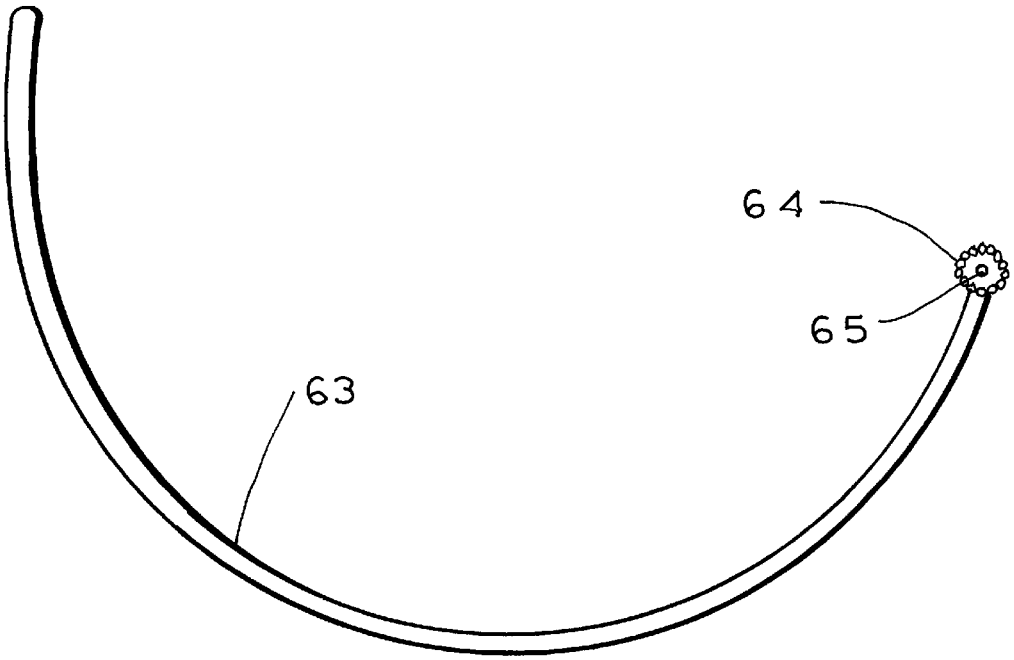
FIG. 14

FIG. 21
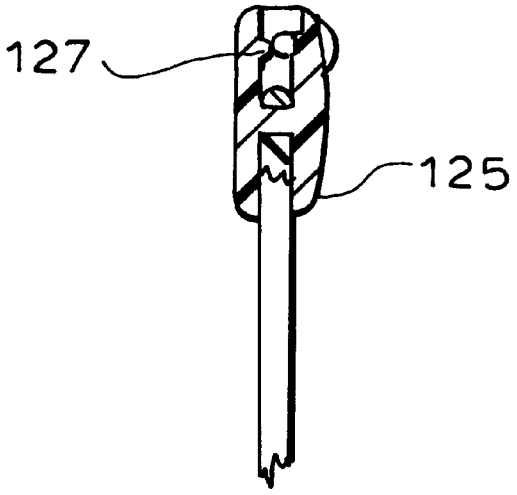
FIG. 18
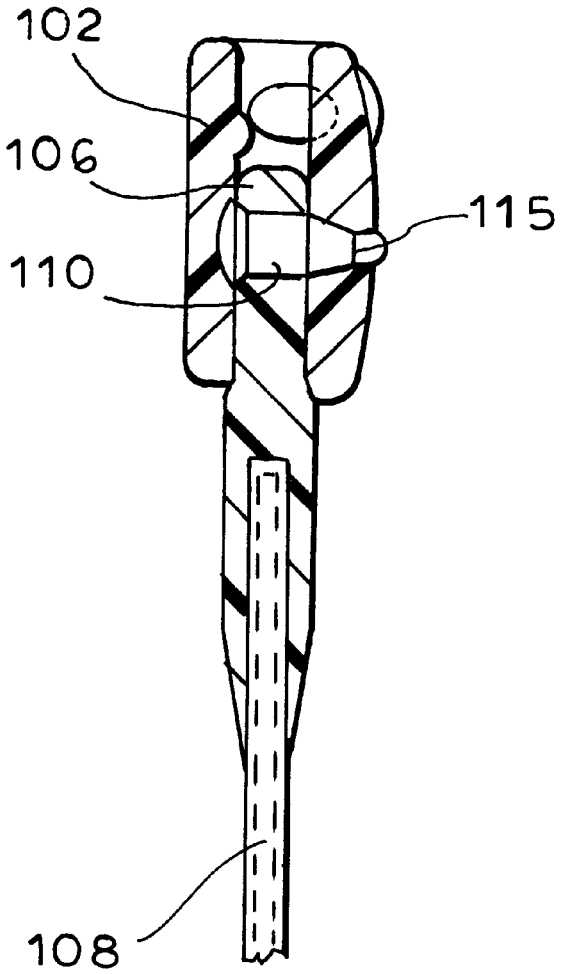
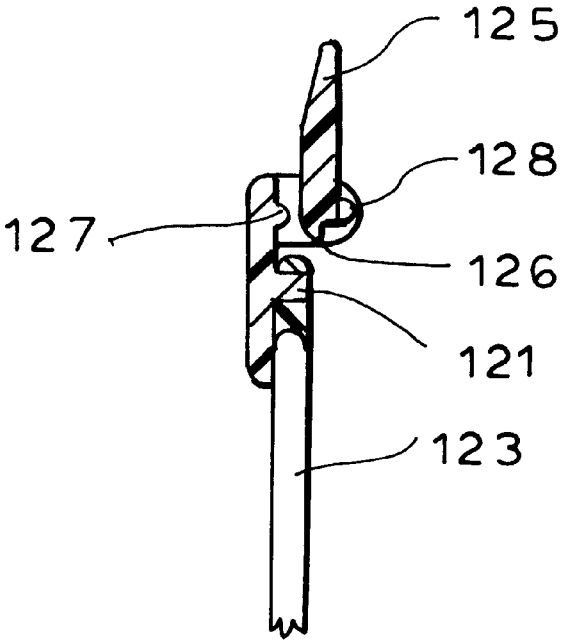
FIG. 23

FIG. 20
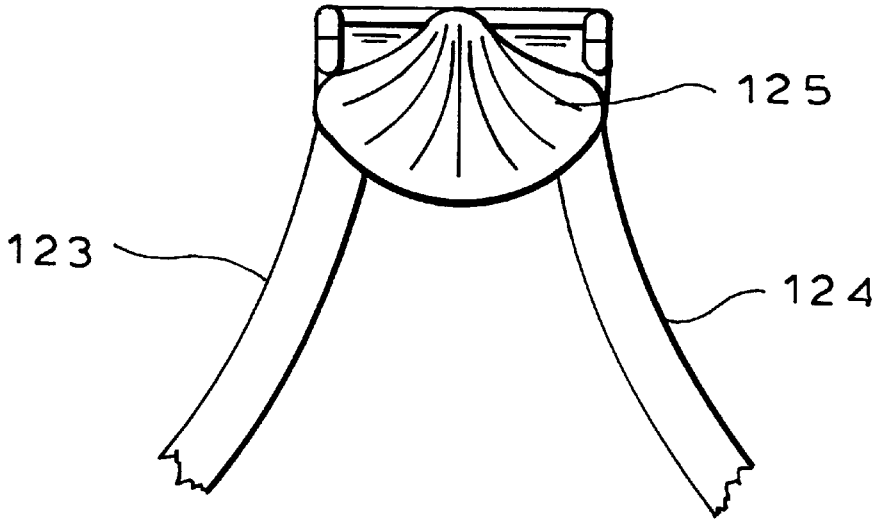
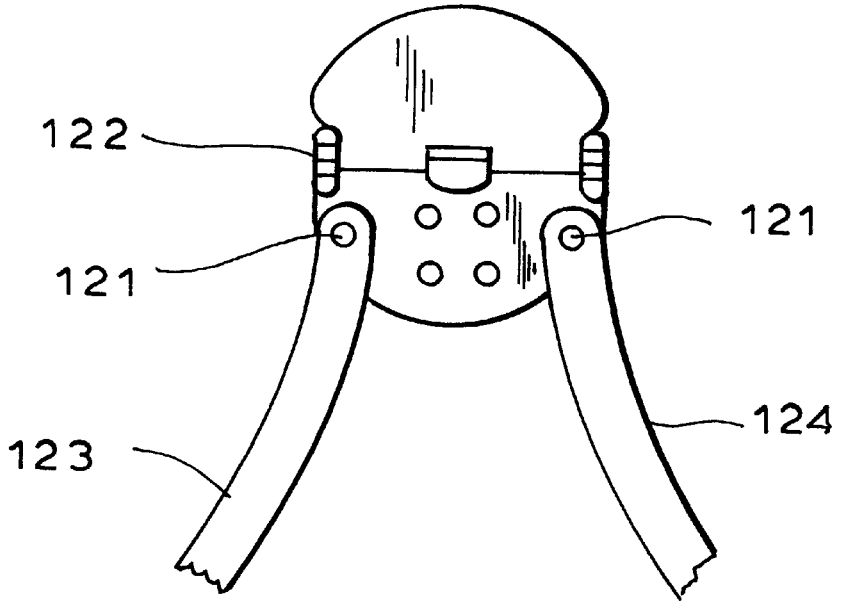
FIG. 22

PIN AND EYE ASSEMBLY FOR BRASSIERES

FIELD OF THE INVENTION

My present invention relates to a pin-and-eye assembly for brassieres, to an improvement in the attachment of underwires to brassieres and to an improvement in underwire construction for brassieres.

BACKGROUND OF THE INVENTION

It is known to provide decorative attachments for a brassiere, generally, by stitching the decorative element to the brassiere, thereby affixing the decoration in a nonreplaceable and nonremovable manner.

It is also known to provide additional support to brassiere cups by forming beneath the fabric of the cup an arcuate pocket or tube, usually by stitching of the fabric, and inserting a so-called "underwire" into the pocket. In the past, such underwires have been composed of metal, plastic or plastic covered metal and have been of a variety of cross sectional shapes, the most common of which have been circular or rectangular sections.

Furthermore, the underwires may be free from interconnection or can be interconnected at the center of the brassiere between the cups thereof by any of a number of types of connectors. For example, the bridge piece between the underwires may be a rigid member, with the underwires being formed in one piece with the bridging member or simply attached thereto. The underwires may have ends which are affixed to a rigid bridge piece during the mounting of the underwire and the stitching of the bridge piece to the fabric of the brassiere. There are also connectors between the underwires in the form of sleeves or the like into which ends of the wires can be fitted to enable the wire to swivel.

With respect to the underwires themselves, the art has recognized the importance of so shaping the underwire so that they are flexible to a limited extent torsionally, i.e. the portions of the underwire can twist out of the natural plane thereof while ensuring a certain degree of rigidity in this plane, i.e. limiting the flexibility of the underwire with respect to its spread between its ends. Such underwires will provide support for and in part shape to the breast received in the brassiere cup cover and above that which is contributed by the fabric of the cup.

By and large, while many of the techniques for attaching decorative elements to a brassiere have been found to be satisfactory, frequently replacement or substitution of decorative elements is desirable and many of the approaches used in the past have proved to be incompletely satisfactory. Furthermore, underwire constructions as used heretofore have also not been fully satisfactory, either because the underwire has contributed to wearer discomfort, or because the underwire was incapable of providing sufficient support or shape retentiveness.

It should also be noted, with respect to prior underwire constructions, that, in some cases, removal of an underwire is desirable, for example, for washing of the brassiere, or to convert the brassiere into a soft brassiere as distinct from an underwire bra. When an underwire brassiere has been laundered in the past, there was a tendency for the underwire to poke through the fabric and to then damage other garments or even injure the washing machine itself. To counter this tendency it has been the practice heretofore to provide extra layers of fabric, thereby increasing the bulkiness of the brassiere.

OBJECTS OF THE INVENTION

It is the principal object of the invention, therefore, to provide a pin-and-eye assembly which will allow at least some of the above mentioned drawbacks to be obviated.

More specifically, it is an object of the invention to provide an improved pin-and-eye system for the attachment of replaceable decorative elements to a brassiere.

Another object of the invention is to provide an improved underwire system for a brassiere which can overcome the drawbacks of the prior underwire arrangements and, specifically, can increase the comfort achieved with an underwire support for a brassiere cup in an esthetic manner which nevertheless ensures effective support for the breast.

It is still another object of this invention to provide an improved underwire system which facilitates assembly and at the same time allows improvement in the decorative aspects of a brassiere.

Yet another object of the invention is to provide a brassiere which allows removal of an underwire for laundering or to convert the brassiere to a soft-cup bra in a particularly convenient manner.

Still another object of the invention is to provide a system which can limit or eliminate the danger of underwire poke through for a brassiere or the like.

SUMMARY OF THE INVENTION

These objects and others that will become apparent hereinafter are attained, in accordance with this invention in a decorative and/or underwire assembly for a brassiere which provides a pin-and-eye connection between a fastening member which is provided with holes through which that member can be affixed to the fabric of a brassiere, preferably at a location between the brassiere cups or close to a fabric portion interconnecting the cups of the brassiere, and a cover member connected by a pin-and-eye connection with that fastening member. The term "pin-and-eye connection" is used herein to refer to a pin in one of the members which is snugly received in an eye or bore formed in the other of the members.

According to one aspect of the invention, the fastening member is a disk formed with a plurality of openings around a central bore receiving a pin on the cover member. That pin can have a mushroom shape enabling it to lock into the bore in a snap fit and in a removable manner. The cover member may be formed unitarily with, i.e. can be molded onto, an end of an underwire, e.g. at a plastic terminus of a metal wire or the integral end of a plastic underwire. Alternatively, the cover member may be independent of any underwire and may form a decorative element in and of itself.

Seated in or molded into the decorative element may be a decoration, for example, a jewelled body simulating a diamond, an element in the form of a pearl or some decorative element representing a floral decoration and the like. Around the central decoration can be a rim which represents miniature pearls or simply in the form of a milled, undulating or ribbed periphery.

The cover element can completely cover the stitches securing the fastening element to the fabric.

According to another aspect of the invention, the fastening element and the cover element can be hinged together and the pin-and-eye connection can be used to connect respective ends of a pair of underwires together. The underwires can be plastic wires or metal wires coated with plastic and received in tubular pockets of the fabric beneath the respective cups.

Advantageously, the ends of the underwires are formed with the holes while the pins are provided on either the fastening member or the cover member and the pins form a snap fit in these holes. The hinged cover member can have recesses which snap onto the pins as well to retain the underwires on the pins.

An important advantage of this embodiment is that the fastening end cover members define a plane to which the pins are perpendicular, the underwires being free to pivot about the pins in this plane while being sufficiently elastically deflectable so that they can twist somewhat out of the plane while the spreadability of each underwire in the plane is minimal.

The underwires, according to the invention preferably have a cross section which, on a side turned toward the body of the wearer, is rounded convexly over the entire length of that side.

Apart from this rounded side, the cross section may be a generally rectangular or triangular cross section with, of course, rounded corners corresponding to edges of the underwire. While the underwire may be composed entirely of plastic with this cross section it has been found to be most advantageous to provide the underwire of metal at least over a portion of the length of the underwire inwardly of the opposite ends thereof and directly below the respective cup. Of course the metal of the underwire can continue to a plastic coated free end tip. At the pivotally connected end at the bridge piece, the metal wire may be encased in a plastic sheath which can project beyond the metal wire and be formed with the hole.

In another aspect of the invention, an ornamental button for a garment, especially a foundation garment such as a brassiere, can have the form of a disk provided along the periphery thereof with at least one circumferential row of pearl formations and angularly equispaced spokes extending inwardly from the pearl formations and separating windows through which the button can be attached (stitched) to the garment.

As noted previously, key to the invention is the fact that both decorative and utilitarian such as decorative button portions and underwires, can be attached by pin-and-eye formations to the garment. Of course, when the button which is stitched to the garment has a central formation adapted to mate with a formation of a decorative element applied thereof, generally the separate but firmly attached externally visible member will be the only member actually seen since the underwire itself may be concealed in the channel or pocket normally formed by stitching beneath the brassiere cup and the base button is concealed by the decorative disk.

Since the base itself is a decorative element it will be applied where the functional aspect is desired and even where a functional aspect is not required, utilizing the spoke and pearl formation pattern to provide an esthetic to the garment.

When the base element is not used in and of itself or even where it is, it can be provided with a central connecting formation, e.g. a hole. The hole may receive a decorative element such as a pearl-shaped or faceted jewel-shaped member on a stud receivable in the hole.

More frequently, the ornamental button for the garment can comprise the externally visible member or disk previously mentioned which can have another central formation mating with the formation of the base disk in a pin-and-eye connection, the decorative external member having an exposed decorative face and preferably a peripheral array of pearl-like formations about its circumference.

The press button may, more particularly, be formed with the pin which has a mushroom shape so that it can snap into the hole in the base member which, in turn, can have a hole which converges from opposite ends toward a constricted middle portion.

While the decorative face of the outer member may be embossed, e.g. with a floral decoration, it can have a recess in which a faceted jewel, imitating a diamond, or a pearl-shaped member is received.

According to another feature of the invention, the press button or pin-and-eye connections serves to attach a member such as a stay or a brassiere underwire to the garment. In that case, an elongated tongue may be molded unitarily with the externally visible member and can be the end of the stay itself when the latter is formed as a one piece molded member or the end of a one piece underwire.

Alternatively, that tongue may be a tip molded onto the end of a metal underwire which may be, if desired, plastic coated by any means conventional in the art of coating metal underwires.

According to yet another aspect of the invention, the underwire itself, which is normally quite rigid in its plane, i.e. normally cannot spread or contract significantly in its plane, should be flexible in torsion when it is bent out of its plane for comfort. It has been found that this can be achieved in a unique manner by providing the underwire cross section so that it is generally polygonal with rounded edges, but has a flank turned toward the sternum of the wearer which is convexly curved toward her body.

The invention also encompasses a brassiere underwire assembly in which the two underwires are interconnected by a bridge piece and nevertheless can pivot in their respective planes. For this purpose a pin-and-eye connection is provided between the brassiere underwires and the bridge piece. More particularly, the bridge piece may comprise a base plate which is stitched to the brassiere fabric and is connected by a hinge to the covered plate overlying that base plate.

Pins can be provided on the base plate and can engage in eyes formed in the underwires. The cover plate can be swung over the pins to lock the underwires on the respective pins and, in a particularly advantageous construction, the cover plate can have recesses receiving tips of the pins protruding through the underwire eyes.

The pin-and-eye construction of the present invention permits removal of an underwire from the pocket containing same in the brassiere simply by disengaging the underwire at the pin-and-eye connection, whether that underwire is formed with the eye or with the pin and whether that underwire is covered by a decorative plate or button or bears the cover decoration directly. With removal of the underwire, e.g. for laundering, after completion of the laundering process the underwire can be reinserted and is engaged with the base member and provided with the cover member if a wire does not carry the covering decoration. In the case of removal of the underwire to convert the brassiere into a so-called soft bra, the decorative base member can remain in place so that, in the future, it can serve again as an anchor for the underwire or to receive a decorative button with any of the patterns described herein should a change in appearance of the garment be desired by the wearer.

Adding to another feature of the invention, a bridgepiece may be used between the cups of the brassiere and can be provided with a coupling member forming pin-and-eye connections to underwires which may be provided with decorative elements such as circumferential pearls, floral or diamond patterns or the like. In that case, the base member may be formed with holes through which the base member can be stitched to the fabric of the brassiere, like embodiments with flap-type members, although in this case flat-covered members need not be used since the underwires bear the decorative formations. In yet another alternative, decorative buttons can be pressed onto the base member with the underwire being received therewith. In all of these cases removal of the underwire for laundering purposes or to convert the brassiere into a soft cup brassiere is readily carried out.

BRIEF DESCRIPTION OF THE DRAWING

The above and other objects, features, and advantages will become more readily apparent from the following description, reference being made to the accompanying drawing in which:

FIG. 2 is an elevational view of such a snap button;

FIG. 3 is a side elevational view of this button drawn to a small scale;

FIG. 4 is a view similar to FIG. 2 of a button utilizing a pearl decoration;

FIG. 5 is a side elevational view thereof;

FIG. 6 is a side view of the button of FIGS. 2 and 3 showing how a stay or underwire can form an integral part thereof;

FIG. 7 is an elevational view of another decorative button using an embossing technique;

FIG. 9 is a cross sectional view through a portion of an underwire showing the stud;

FIG. 10 is an elevational view thereof;

FIG. 11 is an enlarged elevational view of the base;

FIG. 12 is a cross sectional view through the base;

FIG. 13 is an elevational view of another underwire having a molded tip on a metal underwire structure;

FIG. 14 is a view similar to FIG. 13 but showing an integrally molded underwire;

FIGS. 15 and 16 are cross sectional views through the metal underwire of FIG. 13 without its coating or of the plastic underwire of FIG. 14;

FIG. 18 is a cross sectional view taken along the line XVIII—XVIII of FIG. 17;

FIG. 20 is a view similar to FIG. 17 of another embodiment;

FIG. 21 is a cross sectional view through this latter embodiment;

FIG. 22 is an elevational view of this latter embodiment with the cover flipped up;

FIG. 23 is a cross sectional view with the cover raised of this latter embodiment;

SPECIFIC DESCRIPTION

Figure 1:
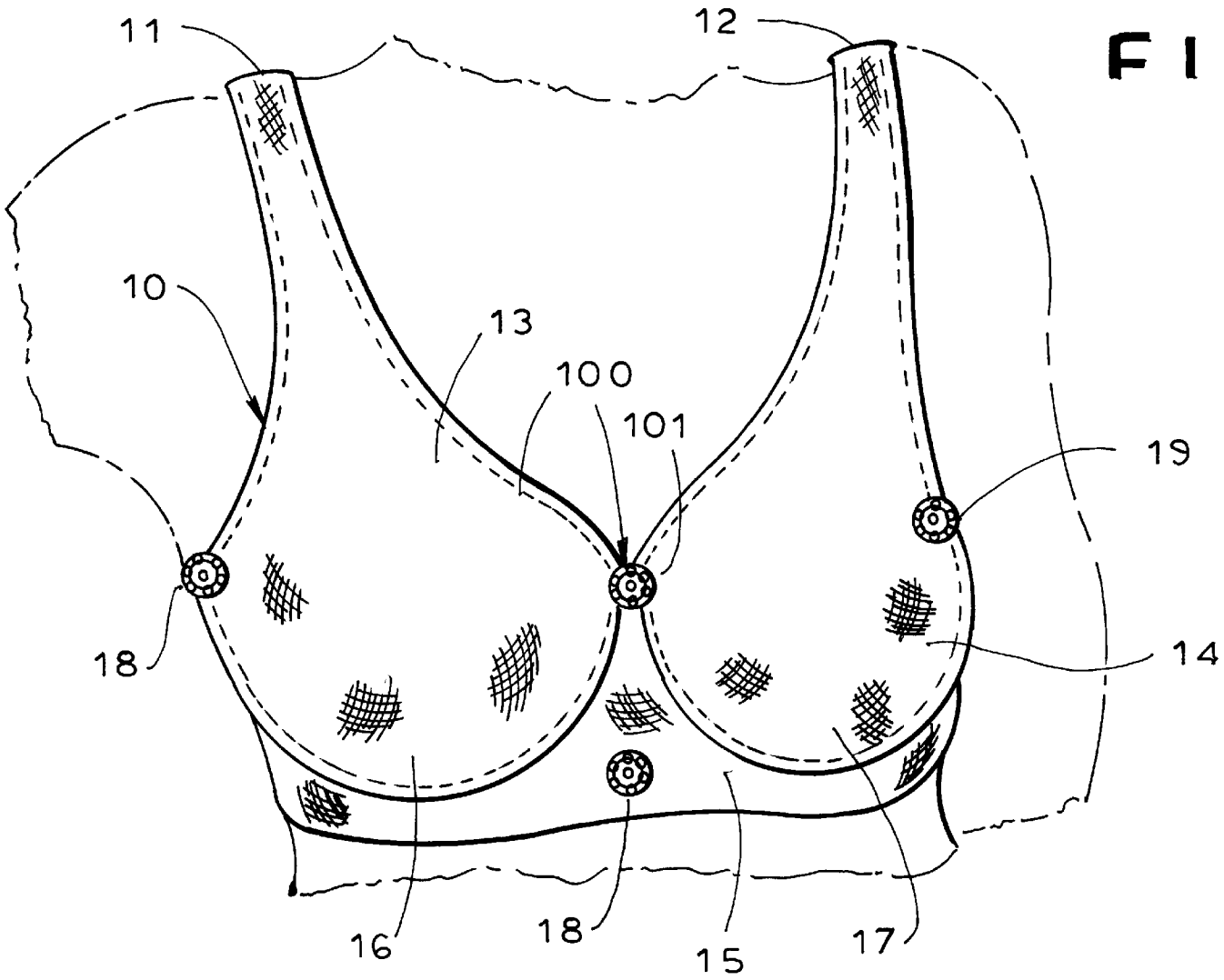
FIG. 1 is an elevational view illustrating a brassiere provided with an underwire assembly in accordance with the invention and which can also be decorated with one or more decorative snap buttons utilizing the pin-and-eye principles of this invention.

FIG. 1 shows a brassiere 10 having a pair of shoulder straps 11, 12 supporting respective brassiere cups 13, 14 defined by stitching on a fabric piece 15 which reaches around to the back of the wearer and is provided with the usual back closure.

Stitched below the cups 13 and 14 are two channels 16, 17 receiving a brassiere assembly as shown in FIGS. 17 through 24 in greater detail and represented here at 100, the bridge piece being shown at 101 and having a scallop shape.

The brassiere is also provided with decorative buttons 18 which, like the assembly 100, can utilize the pin-and-eye principles described generally above. While members 18 are here shown to play a purely decorative role, it will be understood that they can be the ends of stays which are anchored by the base element to the fabric, for corsets and other foundation garments, or even for collar stays of outerwear. They also maybe the anchors, as will be described in greater detail below for underwires which are separately attached to the respective brassiere cups rather than being interconnected by a bridge piece.

Figure 8:
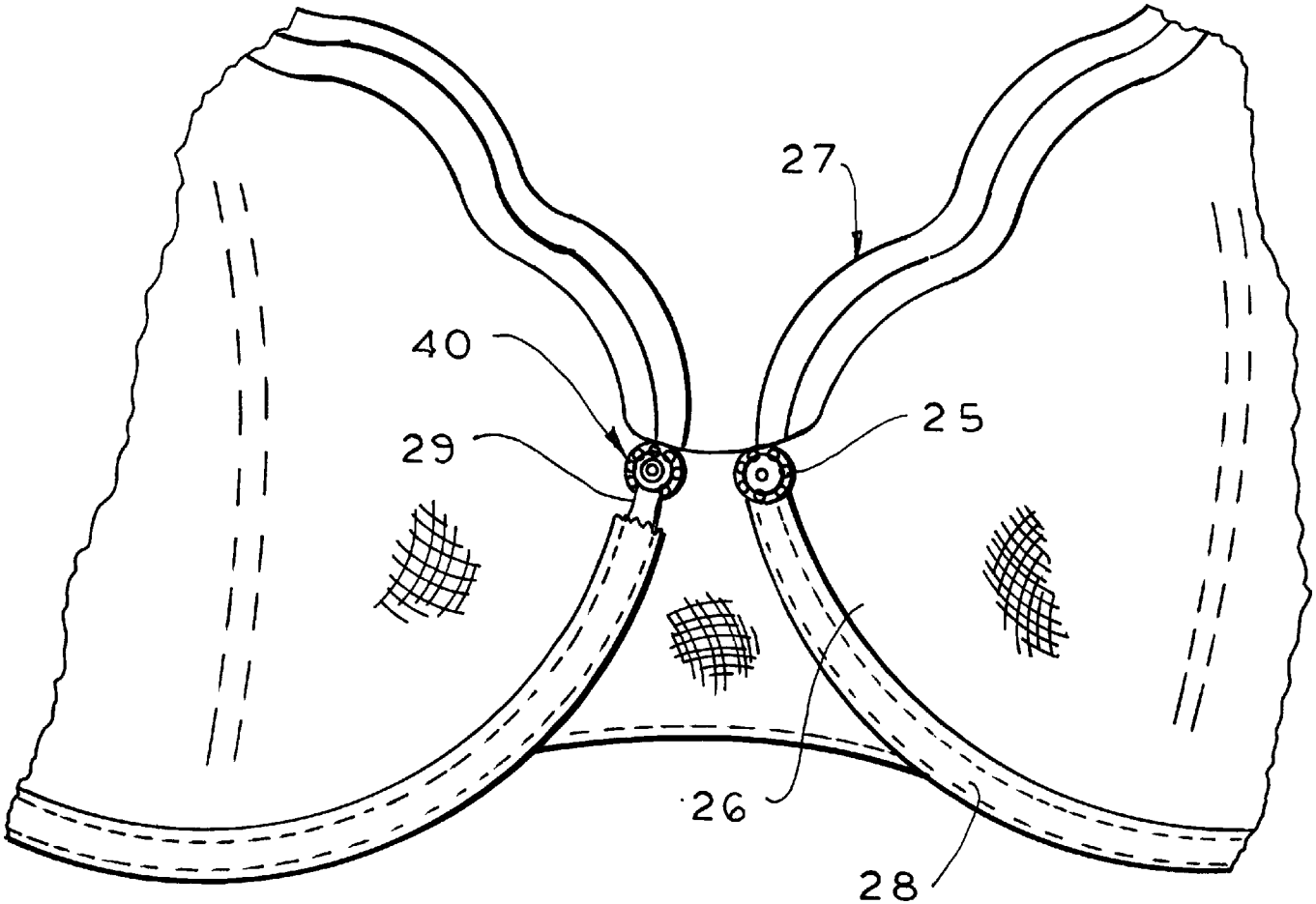
FIG. 8 is a fragmentary elevational view of a portion of a brassiere showing the use of a decorative base and a stud type connection therewith.

In any case, the base member can be a disk shaped member 20 as shown in FIGS. 11 and 12 which can be injection molded with an array or row 21 of pearl formations about its circumference. The row of pearl formations can be connected to a central boss 22 by a plurality of angularly spaced spokes 23 defining windows or openings 24 between them and through which stitching can pass to secure the base 20 to the brassiere. In FIG. 8, for example, at the right hand side, one base 25 is shown to be attached to the fabric 26 of a brassiere 27. It is provided in line with a channel 28 attached to accommodate an underwire 29 (FIGS. 9 and 10), to which a stud 30 has been previously affixed by forcing the pin 31 of this stud through an eye 32 in the underwire 29. That underwire may be a coated metal underwire or a plastic underwire as will be described in greater detail hereinafter.

The pin 31 has a barb 33 which prevents the stud from being separated from the underwire. The underwire can be inserted into the channel 28 and the mushroom shaped formation 34 of the pin forced into the hole 35 at the center of the boss 22 of the base 20, 25. The hole 35, as can be seen from the cross sectional view of FIG. 12, has two tapered portions 36 and 37 converging toward a construction 38 behind which the mushroom head 35 of the pin can lodge. When that stud and underwire are in place, as can be seen on the left hand side of FIG. 8 for the assembly 40, the underwire 29 is in its channel, the stud covers the center portion of the base member 20, 25 and the stitching through the openings 24 is concealed. The stud member 30 may have a recess accommodating a decorative element such as the faceted jewel 41, may be embossed with a decorative pattern or can receive some other jewel-like member such as an imitation pearl.

As can be seen from FIGS. 2 and 3, however, the base member 20 if stitched to the garment for decorative purposes, can be completely covered by an externally snap button member 42 which also can have a pearl ornamentation 43 along its periphery, a faceted jewel 44 received in a recess thereof, and a mushroom shaped pin 45 attached to lodge in the hole of the base member. In another embodiment shown in FIGS. 4 and 5, the externally visible member 46 has the peripheral ornamentation 47 of a row of pearls but the center ornamentation is a larger pearl like member 48 received in a recess in the member 46. The mushroom shaped pin 49 is here also provided to enable this external member to snap into the base member.

As can be seen from FIG. 6, in the case of the decorative outer members which can be used to ornament snap buttons, the outer member may be made unitary, i.e. injection molded in one piece except for the jewel insert, with a stay or underwire as represented at 50 for the decorative button 51 with its pin 52. In all of these embodiments, the decorative button completely covers the base so that only the decorative button is visible when applied to the garment.

FIG. 7 shows a decorative button 53 which, instead of having a jeweled centerpiece, has embossing thereon, e.g. in the pattern of a flower 54 or any other kind of decoration as well. One of the advantages of the system of the invention is that it allows the user to decorate the garment as she may feel is suitable simple by snapping apart the press button, i.e. removing the decorative outer member and replacing it with an outer member with a different decorative function. For example, the faceted jewel outer member can be replaced by the pearl outer member.

When the underwire is a metal underwire as has been shown at 60 in FIG. 13, it may be powder coated but is provided, in accordance with the invention, with a plastic tip 61. That tip can be unitarily molded with the outer button 62 as has been described in connection with FIGS. 2 through 7. The underwire can also be formed by injection molding in one piece with the decorative button as has been shown at 63 where the underwire is composed of plastic and terminates in the molded decorative button 64. In FIG. 13, a faceted jewel insert has been provided in the recess whereas in FIG. 14, the recess 65 which can accommodate a faceted jewel or pearl like is readily visible.

Whether the underwire is of the plastic type or of the metal type, it preferably has the cross section shown in FIG. 16, i.e. is generally rectangular or somewhat trapezoidal, is of the configuration of a polygonal with rounded edges at 66 and a rounded flank 67 which is convex toward the sternum of the wearer. This configuration has been found to provide a high degree of stiffness in the plane of the underwire, but to allow flexibility transverse to this plane when, for example, twisting forces are applied to the underwire accommodation of such twisting forces but the underwire contributor to the comfort.

FIG. 15 shows another embodiment of the cross section of the underwire which has been found to be advantageous and this cross section is generally of a triangular shape with rounded edges at 68 but with the convexly curved flange 69 previously described.

Figure 17:
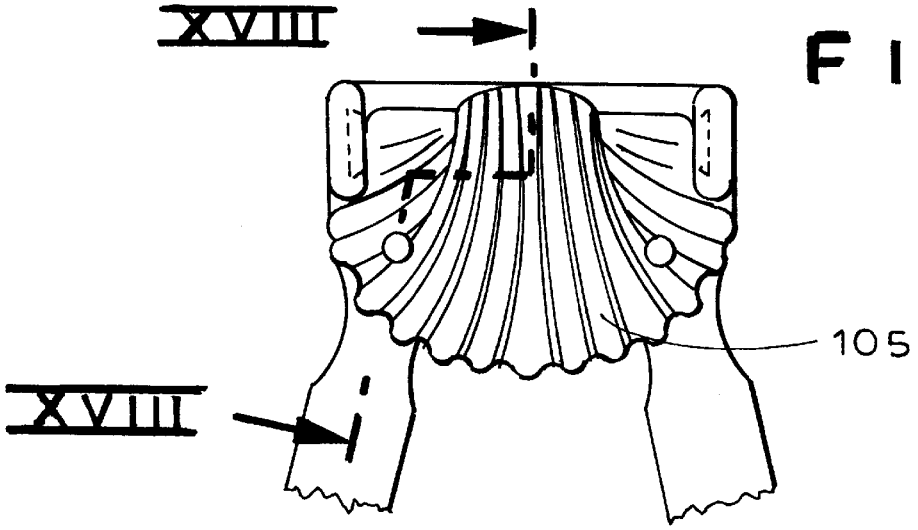
FIG. 17 is an enlarged elevational view of the underwire assembly showing a bridge piece with a scallop decoration.
Figure 19:
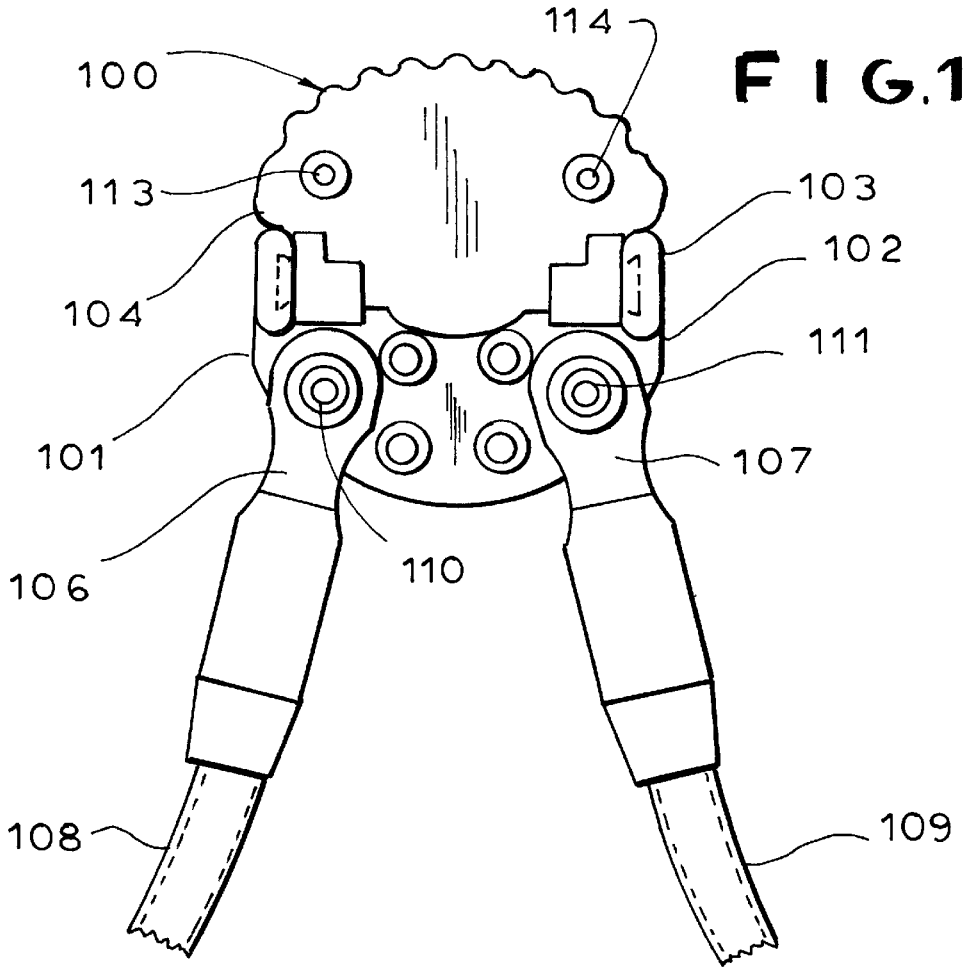
FIG. 19 is an elevational view of the bridge piece with the cover plate flipped up.

A suitable underwire assembly 100, uses a bridge piece 101 as has been shown in FIGS. 17 through 19 and comprises a base plate 102 connected by a hinge 103 to a cover plate 104. The cover plate 104 has a decorative pattern 105 on its outer surface and here the decorative pattern is that of a scallop shell although other decorative patterns may be used (see FIG. 20). The cover plate 104 is swung upwardly in FIG. 19 to show the position in which the eyes 106 and 107 of the underwires 108 and 109 can be inserted over the pins. The pins, shown at 110, 111 are molded unitarily with the base plate 102 which is provided with holes 112 allowing the base plate to be stitched to the brassiere fabric. The cover 104 can be hinged on base plate which can be stitched to the brassiere fabric. The cover 104 can be flipped up to allow the underwires to be pulled off the pins and removed from the garment where desired. When the underwires are to be locked in place, the cover is closed enabling the recesses 113 and 114 to engage over the tips 115 of the pins which project through the eyes 106, 107.

As is also apparent from FIGS. 17 through 19, the tips 106 and 107 are molded from plastic material onto the metal underwires 108, 109 which may have been previously powder coated with a synthetic resin material.

The embodiment of FIG. 20 or FIG. 23 differs from that of FIGS. 17 through 19 in that the bottom plate 120 is unitarily molded with the pins 121 and the hinge formations 122 but the pins 121 are flush with the plastic underwires 123, 124 which are of uniform thickness and cross section throughout their lengths. Since the pins 121 do not project beyond the underwires 123, 124, there are no projecting pin tips which engage the cover plate 125. In that case, in order to latch the cover plate in its closed position, the cover plate may be provided with a lug 126 engaging a bump 127 on the base plate 120. To that lug holds the cover plate in the open position until the plate bases bump 127. Another bump 128 on the cover plate engages behind the bump 127 (see FIG. 21) to hold the cover plate closed until it is forced open by hand.

Figure 24:
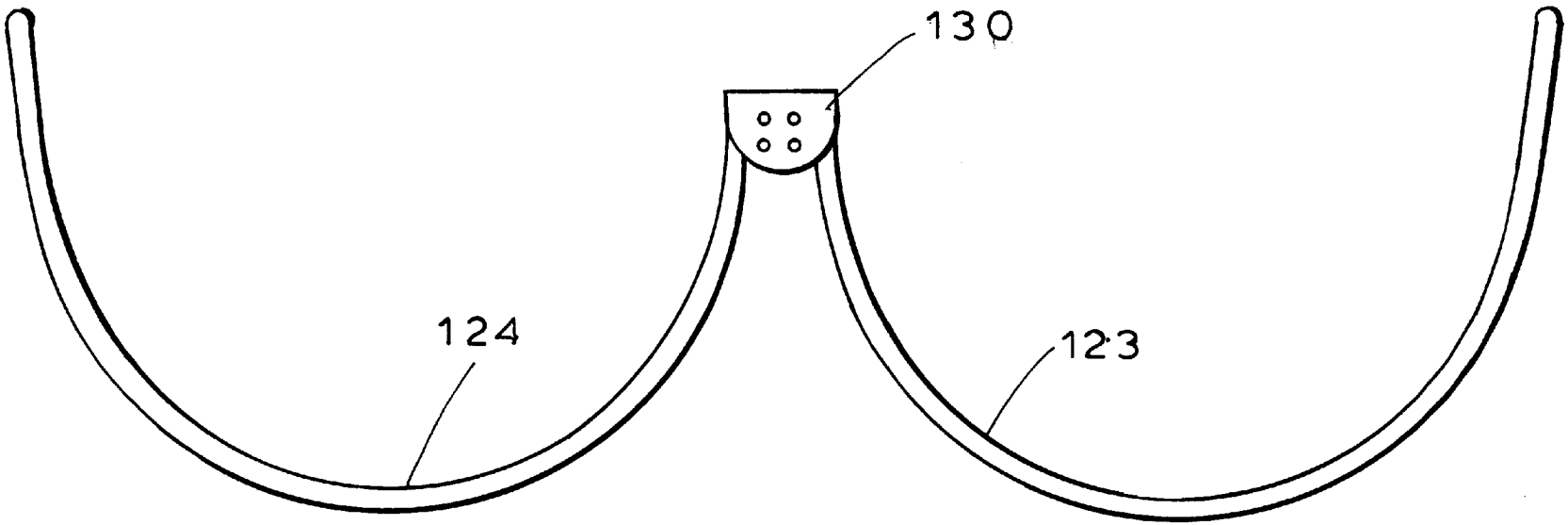
FIG. 24 is a rear view of the brassiere underwire assembly.

FIG. 24 shows a rear view of the assembly of either FIGS. 17 to 19 or FIGS. 20 to 23 and it will be apparent that the underwires 123 and 124 can pivot with respect to the bridge piece 130 in the plane of the underwire, are comparatively stiff with respect to spreading in the plane, but can flex into and out of the plane.

In all of the embodiments in which underwires are removably attached by a pin-and-eye connection to the fabric, by separation of the pin-and-eye connection, the underwire can be removed for laundering of the brassiere or even to permanently transform the brassiere from an underwire to a soft cup bra.

The base member can remain in place as a decorative element itself or with its decorative flap or a cover member which can be connected to the base member by a pin-and-eye connection.

Figure 25:
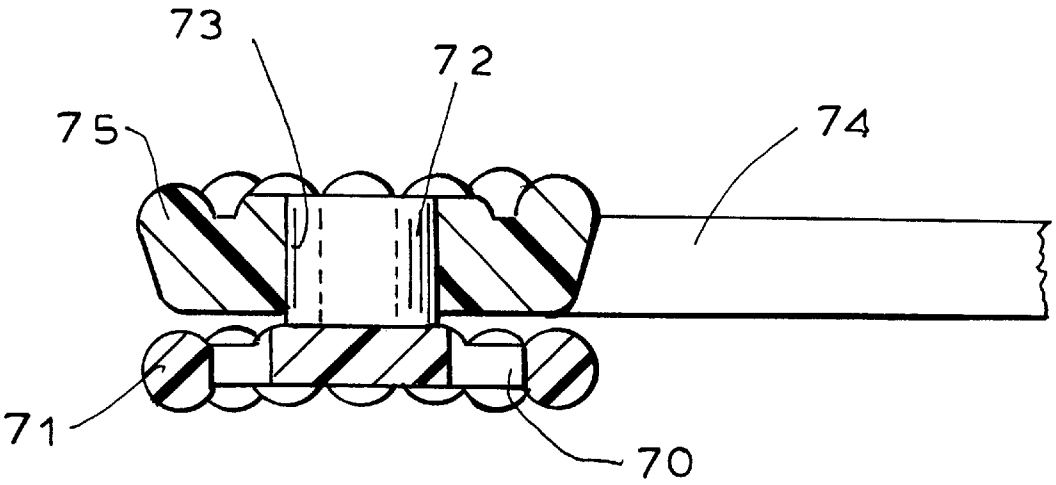
FIG. 25 is a cross sectional view illustrating another embodiment of a pin-and-eye underwire attachment system according to the invention.

In the embodiment of FIG. 25, the base member 70 is provided with the circumferential pearl decoration 71 and with a central pin 72 which is engaged in an eye 73 formed in the underwire 74. Here the underwire is formed with a pearl-shaped annular array of formations as a decoration and, if desired, a diamond-shaped member can be seated in a recess in the pin 72 or can be provided at the center of the pearl cluster 75. In this case, the eye formed by the underwire is directly provided with the outer decor.

In the embodiment of FIG. 25 the base member 70 can have the appearance of that of FIG. 11, except that, instead of an eye or a hole at the center, the base member is formed with the pin.

Figure 26:
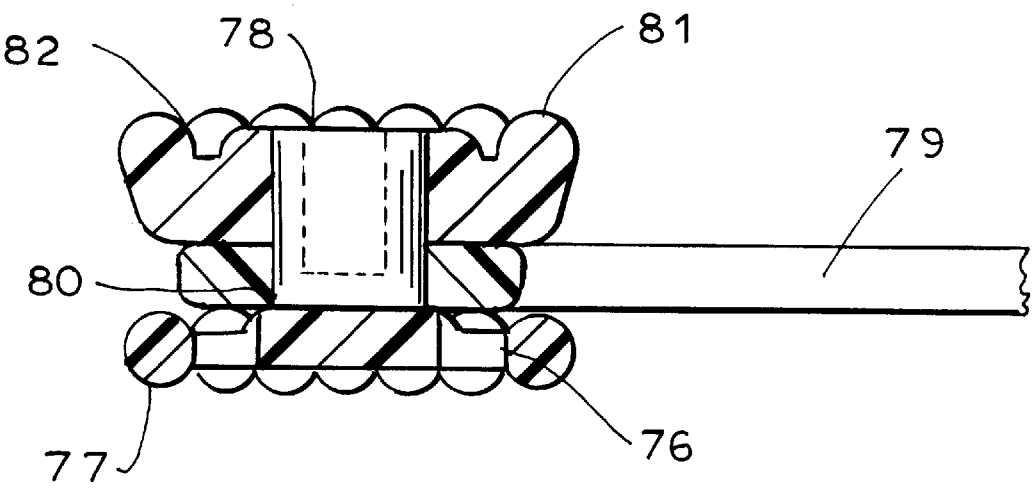
FIG. 26 is a cross sectional view through a further pin-and-eye arrangement.

In FIG. 26 another pin-and-eye arrangement is shown wherein the base member 76 has the pearl-shaped circumference 77 and the central pin, but the underwire 79 has an eye 80 which can be forced over the pin 78. The portion of the pin protruding through the eye 80 can receive the cover member 81 which is formed with the circumferential array of pearl formations represented at 82. Here a separate member 81 forms the outer decor.

Figures 27, 28, 29:
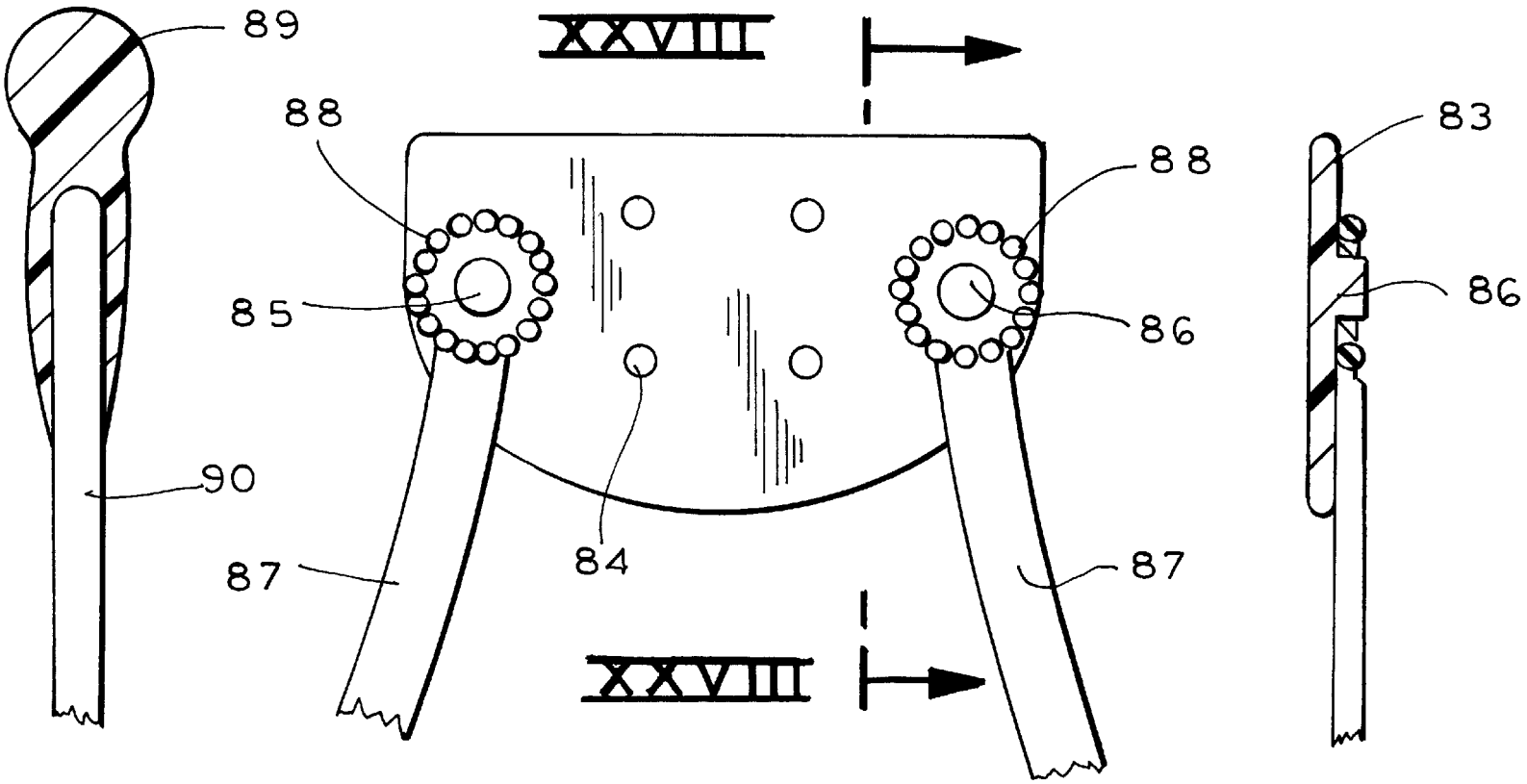
FIG. 27 is a fragmentary elevational view showing an embodiment using a bridgepiece like that of FIG. 22 but without a cover flap.
FIG. 28 is a cross sectional view taken along the line XXVIII—XXVIII of FIG. 27.
FIG. 29 is a cross sectional view through a soft rubber tip molded on or provided by dipping on the end of the underwire remote from the pin-and-eye connection.

As can be seen from FIGS. 27 and 28, a bridgepiece 83, similar to that shown at 120 in FIG. 22 can be provided with holes 84 enabling it to be sewn onto the brassiere fabric between the cups of the brassiere, pins 85 and 86 being molded on the base member 83 and engaging in eyes of underwires 87 which have circular arrays 88 of pearl formations around these eyes to provide the decor. In this case a flap bearing the outer decor is not necessary. All of the underwires which have been described can have at their ends remote from the pin-and-eye connections, tips 89 of soft rubber or a soft plastic molded onto the stiffer underwire 90 to reduce the danger that the wire will poke through the fabric. In that case, the pearl cluster may be injection molded at the end of the underwire forming the pin-and-eye connection (see FIGS. 25 and 27) while the opposite end is provided with the soft tip, which can have generally a ball shape.

I claim:

1. An attachment base for a garment, comprising a disk provided along a periphery thereof with at least one circumferential row of pearl formations, said disk having a plurality of angularly equispaced spokes extending inwardly from said row of pearl formations and separating openings through which said button can be stitched to said garment, said disk further being provided with means enabling use of said disk for attachment of another element to said garment.

2. An ornamental button including the attachment base defined in claim 1 wherein said disk has a central connecting formation, said button further comprising an externally visible member provided with another central connecting formation mating with said central connecting formation of said disk in a pin-and-eye connection, said externally visible member having an exposed decorative face.

3. The ornamental button defined in claim 2 wherein said exposed decorative face is provided with a recess receiving a facetted jewel.

4. The ornamental button defined in claim 2 wherein said exposed decorative face is provided with a recess receiving a pearl-shaped jewel.

5. The ornamental button defined in claim 2 wherein said exposed decorative face has an embossed floral ornamentation provided thereof.

6. The ornamental button defined in claim 2 wherein said central connecting formation of said disk is a hole and said central connecting formation of said externally visible member is a mushroom-shaped pin snap-fitted in said hole.

7. The ornamental button defined in claim 2, further comprising an elongated tongue received between said disk and said externally visible member.

8. The ornamental button defined in claim 2, further comprising an elongated tongue molded unitarily with said externally visible member.

9. The ornamental button defined in claim 8 wherein said tongue is a garment stay.

10. The ornamental button defined in claim 8 wherein said tongue is a one-piece molded underwire for a brassiere.

11. The ornamental button defined in claim 8 wherein said tongue is a molded tip for a metal underwire for a brassiere.

12. The ornamental button defined in claim 11 wherein said underwire has a generally polygonal cross section with rounded edges and a flank adapted to be turned toward the sternum of a wearer which is convexly curved toward the wearer.

13. The ornamental button defined in claim 12 wherein said metal underwire is coated with a plastic.

14. The ornamental button defined in claim 2 wherein said externally visible member is a circular disk formed with a row of pearl-shaped formations along a periphery thereof and completely conceals the stitching through said openings.

15. A termination for an underwire for a brassiere including the attachment base defined in claim 1 wherein said disk has a central connecting formation, said wire having another central connecting formation mating with said central connecting formation of said disk in said pin-and-eye connection and means forming an exposed decorative face at said pin-and-eye connection wherein said underwire is attached to said base.

16. The termination defined in claim 15 wherein one of said formations is a pin and said underwire has a hole, said pin extending through said hole.

17. The termination defined in claim 15 wherein said underwire is formed directly with said decorative face.

18. The termination defined in claim 15 wherein said decorative face is on a cover member overlying said underwire.

19. A brassiere underwire comprising an elongated arcuate member of curved configuration, said member having a generally polygonal cross section with rounded edges and a flank adapted to be turned toward the sternum of a wearer which is convexly curved toward the wearer.

20. The brassiere underwire defined in claim 19 wherein said member is of generally rectangular or triangular cross section, is coated with plastic and has a molded plastic tip on an end of said member.

21. The brassiere underwire defined in claim 19 defined in claim 16 wherein said tip is formed unitarily with an externally visible disk-shaped member provided having an exposed decorative face.

22. The brassiere underwire defined in claim 21 wherein said externally visible member is a circular disk formed with a row of pearl-shaped formations along a periphery thereof.

23. A brassiere underwire comprising an elongated arcuate member of curved configuration and having a pair of opposite ends, one of said ends being provided with a formation forming a pin-and-eye connection with a base affixed to a brassiere and with a circular row of pearl-shaped formations around said formation.

24. The brassiere underwire as defined in claim 23 further comprising means forming a soft tip at an opposite end of said arcuate member.

25. The brassiere underwire as defined in claim 24 wherein said soft tip is generally ball shaped.

26. A brassiere underwire assembly comprising:

a central bridge piece having a base plate formed with means for stitching said baseplate to a brassiere between respective cups thereof, and a cover plate hinged to said base plate and adapted to overlie said baseplate and conceal stitching thereof to the brassiere, and a pair of connecting formations formed on one of said plates; and respective underwires receivable in elongated channels in said brassiere beneath the respective cups, each of said underwires having a mating connecting formation engaging one of the connecting formations of said pair in a pin-and-eye connection enabling each underwire to swivel in a plane of the respective underwire.

27. The brassiere underwire assembly defined in claim 26 wherein said connecting formations of said pair are pins projecting from said base plate and said cover plate has recesses receiving tips of said pins protruding through eyes in said underwires.

28. The brassiere underwire assembly defined in claim 27 wherein each of said underwires is an elongated arcuate member of curved configuration, said member having a generally polygonal cross section with rounded edges and a flank adapted to be turned toward the sternum of a wearer which is convexly curved toward the wearer.

29. The brassiere underwire assembly defined in claim 28 wherein said member is of generally rectangular or triangular cross section, is coated with plastic and has a molded plastic tip on an end of said member.

30. The brassiere underwire assembly defined in claim 29 wherein said cover plate is in a shape of a shield having ornamentation embossed thereon.

31. A brassiere underwire assembly comprising:

a central bridgepiece having a base plate formed with means for stitching said base plate to a brassiere with respective cups thereof, and a pair of connecting formations formed on said base plate;

respective underwires receivable in elongated channels in said brassiere beneath the respective cups, said of said underwires having a mating connecting formation engaging one of the connecting formations of said pair in a pin-and-eye connection; and means forming a decorative face exposed to view and overlying said base plate.

32. The assembly defined in claim 31 wherein said means forming said decorative face includes a button press-fitted onto said base plate and having a circumferential row of pearl-shaped formations.

33. The assembly defined in claim 31 wherein said means forming said decorative face is an annular row of pearl-shaped formations provided directly on each of said underwires.

* * * * *